US007775534B2

(12) United States Patent
Chen et al.

(10) Patent No.: US 7,775,534 B2
(45) Date of Patent: Aug. 17, 2010

(54) FLEXIBLE SKATEBOARD WITH GRINDING TUBE

(75) Inventors: Robert Chen, San Marino, CA (US); Robert A. Hadley, Yorba Linda, CA (US)

(73) Assignee: Razor USA, Inc., Cerritos, CA (US)

( * ) Notice: Subject to any disclaimer, the term of this patent is extended or adjusted under 35 U.S.C. 154(b) by 136 days.

(21) Appl. No.: 11/946,439

(22) Filed: Nov. 28, 2007

(65) Prior Publication Data

US 2009/0134591 A1 May 28, 2009

(51) Int. Cl.
*B62M 1/00* (2010.01)

(52) U.S. Cl. ..... 280/87.042; 280/87.01

(58) Field of Classification Search ..... 280/11.25, 280/11.27, 11.28, 87.01, 87.021, 87.041, 280/87.042, 87.03, 87.05, 268, 271
See application file for complete search history.

(56) References Cited

U.S. PATENT DOCUMENTS

| | | | | | |
|---|---|---|---|---|---|
| 3,771,811 | A * | 11/1973 | Bueno | 280/87.042 |
| 4,076,267 | A * | 2/1978 | Lipscomb | 280/87.042 |
| 4,082,306 | A * | 4/1978 | Sheldon | 280/87.042 |
| 4,359,231 | A * | 11/1982 | Mulcahy | 280/87.01 |
| 4,930,924 | A * | 6/1990 | Hunt | 403/24 |
| 4,955,626 | A * | 9/1990 | Smith et al. | 280/87.042 |
| 5,458,351 | A * | 10/1995 | Yu | 280/87.042 |
| 5,540,455 | A * | 7/1996 | Chambers | 280/87.042 |
| 5,884,983 | A * | 3/1999 | Wu | 301/124.1 |
| 6,056,302 | A * | 5/2000 | Smith | 280/87.042 |
| 6,485,044 | B1 * | 11/2002 | Blake | 280/288.4 |
| 6,572,130 | B2 * | 6/2003 | Greene et al. | 280/266 |
| 6,863,292 | B1 * | 3/2005 | Paasch et al. | 280/291 |
| 6,976,687 | B2 * | 12/2005 | Beleski, Jr. | 280/87.041 |
| 7,083,178 | B2 * | 8/2006 | Potter | 280/87.042 |
| 7,093,842 | B2 * | 8/2006 | Chmelar | 280/87.042 |
| 7,182,360 | B2 * | 2/2007 | Paasch et al. | 280/291 |
| 7,195,259 | B2 | 3/2007 | Gang | |
| 7,338,056 | B2 * | 3/2008 | Chen et al. | 280/87.042 |
| 2003/0155725 | A1 * | 8/2003 | Roderick | 280/11.223 |
| 2004/0212160 | A1 * | 10/2004 | Roderick | 280/11.24 |
| 2004/0262872 | A1 * | 12/2004 | Kang | 280/87.042 |
| 2006/0055137 | A1 * | 3/2006 | Jiang | 280/87.042 |
| 2006/0163830 | A1 * | 7/2006 | Kwak | 280/87.042 |

(Continued)

FOREIGN PATENT DOCUMENTS

KR 10-2004-0076242 * 9/2004

*Primary Examiner*—Glenn Dayoan
*Assistant Examiner*—Brodie Follman
(74) *Attorney, Agent, or Firm*—Brunell IP, PC; Norman E. Brunell

(57) ABSTRACT

A skateboard may include a pair of foot support boards connected by a torsion bar connecting element, a torsion bar cover tube mounted to the foot support boards and surrounding at least a portion of the torsion bar connecting element and an outer tube mounted for rotation around the torsion bar cover tube in response to contact with an obstacle. One or more bushings supporting the outer tube on the torsion bar cover for rotation. The skate board may include a tube mounted for rotation on a connecting element between the foot support areas. A method of skateboarding may include providing a skateboard having a longitudinal axis running between a pair of foot support areas and providing a tube mounted for rotation about the longitudinal axis between the foot support areas in response to contact with an obstacle.

8 Claims, 4 Drawing Sheets

U.S. PATENT DOCUMENTS

2007/0132199 A1* 6/2007 Smith ..... 280/14.21
2007/0257459 A1* 11/2007 Gang ..... 280/87.042
2007/0273118 A1* 11/2007 Conrad ..... 280/87.042
2007/0296164 A1* 12/2007 Roderick ..... 280/11.19
2009/0045598 A1* 2/2009 Lee ..... 280/87.042

* cited by examiner

FLEXIBLE SKATEBOARD WITH GRINDING TUBE

BACKGROUND OF THE INVENTION

1. Field of the Invention

This invention is related to skateboards and particularly to skateboards in which one end of the skateboard may be twisted or rotated, with respect to the other end, by the user.

2. Description of the Prior Art

Various skateboard designs have been available for many years. Skateboards have been developed in which a front platform and a rear platform are spaced apart and interconnected with a torsion bar or other element which permits the front or rear platform to be twisted or rotated with respect to the other platform. Such skateboards have limitations related to various maneuvers such as grinding. Grinding refers to the skateboard over obstacles, such as steps and along walls, where an edge of the obstacle grinds against a portion of the body of the skateboard, such as the torsion bar or a torsion bar housing, rather than just the wheels.

What is needed is a new skateboard design without such limitations.

SUMMARY OF THE DISCLOSURE

A flexible skateboard may have a pair of foot support boards, a torsion bar connecting element mounted at each end to one of the foot support boards, a torsion bar cover tube mounted at end to one of the foot support boards and surrounding at least a portion of the torsion bar connecting element and an outer tube mounted for rotation around the torsion bar cover tube in response to contact with an obstacle. One or more bushings may be used to support the outer tube on the torsion bar cover for rotation. A pair of bushings, each supporting an end of the outer tube on the torsion bar cover for rotation, may be used.

Each end of the torsion bar cover tube may be mounted in a cavity in one of the pair of foot support boards. Both ends of the torsion bar cover tube may be mounted in the cavities for rotation within the pair of foot support boards. At least one end of the torsion bar cover tube may be mounted in the cavity for rotation within one of the pair of foot support boards. At least one end of the torsion bar cover tube may be fixedly mounted in the cavity within one of the pair of foot support boards to prevent rotation of the tube with respect to the foot support board. Both ends of the torsion bar cover tube may be fixedly mounted in the cavities within the pair of foot support boards to prevent rotation of the tube with respect to the foot support board.

The foot support boards may be separated by more than the length of the outer tube to permit rotation of the outer tube with respect to each of the foot support boards. The outer tube length may be appropriate for use of the outer tube as a balanced handle for carrying the skateboard.

In another aspect, the skateboard may include a pair of foot support areas separated by a connecting element along a longitudinal axis running through the pair of foot support areas and a tube mounted for rotation on the connecting element between the foot support areas. One or more bushings may support the tube for rotation. A pair of bushings may each support an end of the tube for rotation. The connecting element may include an inner tube having one end mounted in each foot support areas supporting the tube for rotation.

The foot support areas may be mounted on the inner tube separated by a first distance greater than a length of the tube.

The tube may be centered between the foot support areas to provide a balanced carrying handle for the skateboard.

A method of skateboarding may include providing a skateboard having a longitudinal axis running between a pair of foot support areas and providing a tube mounted for rotation about the longitudinal axis between the foot support areas in response to contact with an obstacle. The tube may be mounted for rotation on one or more bushings between the tube and an inner tube extending between the foot support areas. Each end of the tube may be mounted on a separate bushing between the tube and a portion of the inner tube extending between the foot support areas. A torsion element may be mounted between the pair of foot support areas to control twisting of the foot support areas relative to each other along the longitudinal axis.

DETAILED DISCLOSURE OF THE PREFERRED EMBODIMENT(S)

Figure 1:
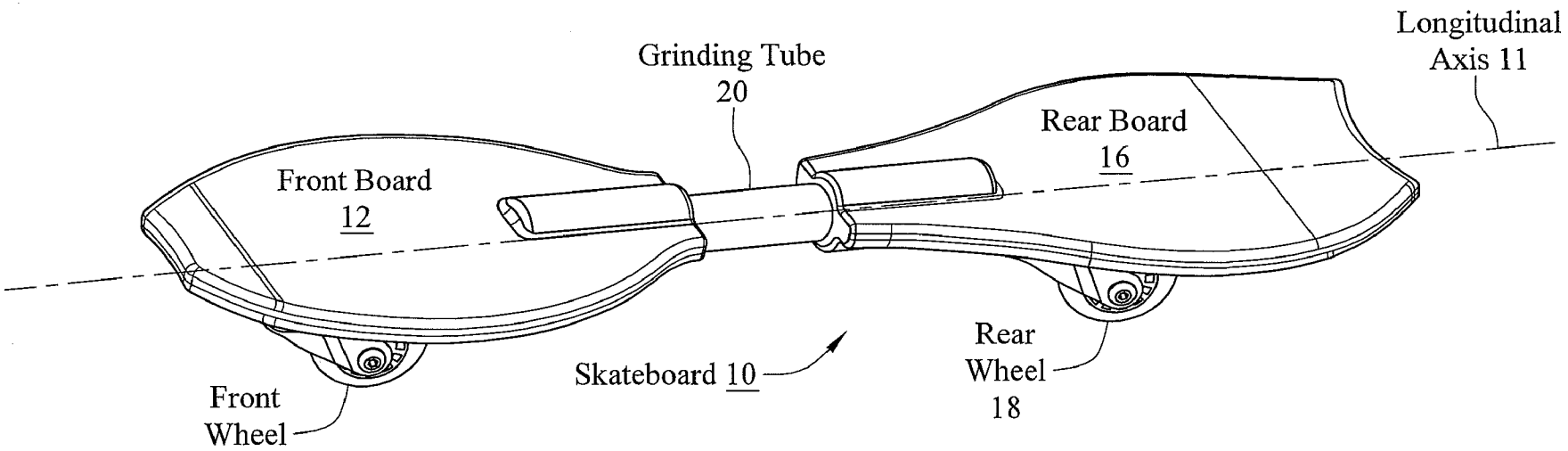
FIG. 1 is an isometric view of a two piece flexible skateboard 10 with a grind tube 20 mounted around a connecting element between front and rear boards 12, 16.

Referring now to FIG. 1, flexible skateboard 10 includes front board 12 mounted over caster wheel 14, rear board 16 mounted over caster wheel 18 and grinding tube 20 mounted for rotation between front and rear boards 12, 16. Front and rear boars 12, 16 and grinding 20 are positioned along longitudinal axis 11. The length of grinding tube 20 between front and rear boards 12, 16 permits grinding tube 20 to be used as a handgrip by a skateboard user to carry skateboard 10.

In operation, the user places one foot on front board 12 and the other foot on rear board 16. Skateboard 10 may be ridden by rotating front board 12 relative to rear board 16 which causes a torsion element or torsion bar, shown below in FIGS. 2 and 3, to twist. When skateboard 10 is ridden in a so-called grinding maneuver, an obstacle such as the edge of a stair or curb or wall contacts skateboard 10 typically in the center of the board at grinding tube 20. Alternately, skateboard 10 may be contacted by the obstacle first at one of the boards, such as front board 12. As skateboard 10 moves forward, the contact point may move from front board 12 across grinding tube 20 to rear board 16. Of course, the maneuver may be performed in reverse so that rear board 16 is contacted first, then grinding tube 20 and then front board 12. The point of contact may often be an edge of an obstacle so that an elongated contact is made between a contact edge of the obstacle and a surface or edge of skateboard 10.

A grinding maneuver may made so that skateboard 10 is ridden by a combination of the obstacle edge grinding against grinding tube 20, and/or the rotation of grinding tube 20, so that front and rear wheels 14, 18 are not supporting, or at least not fully supporting, skateboard 10 during at least a portion of the maneuver. The length of time, or the distance traveled, during which skateboard 10 is in a grinding maneuver, that is, the time during which the weight of the rider is support by grinding rather than by riding on the wheels, is often a mark of the success of the grinding maneuver. In other words, often the longer the successful grind, the better the maneuver.

Figure 2:
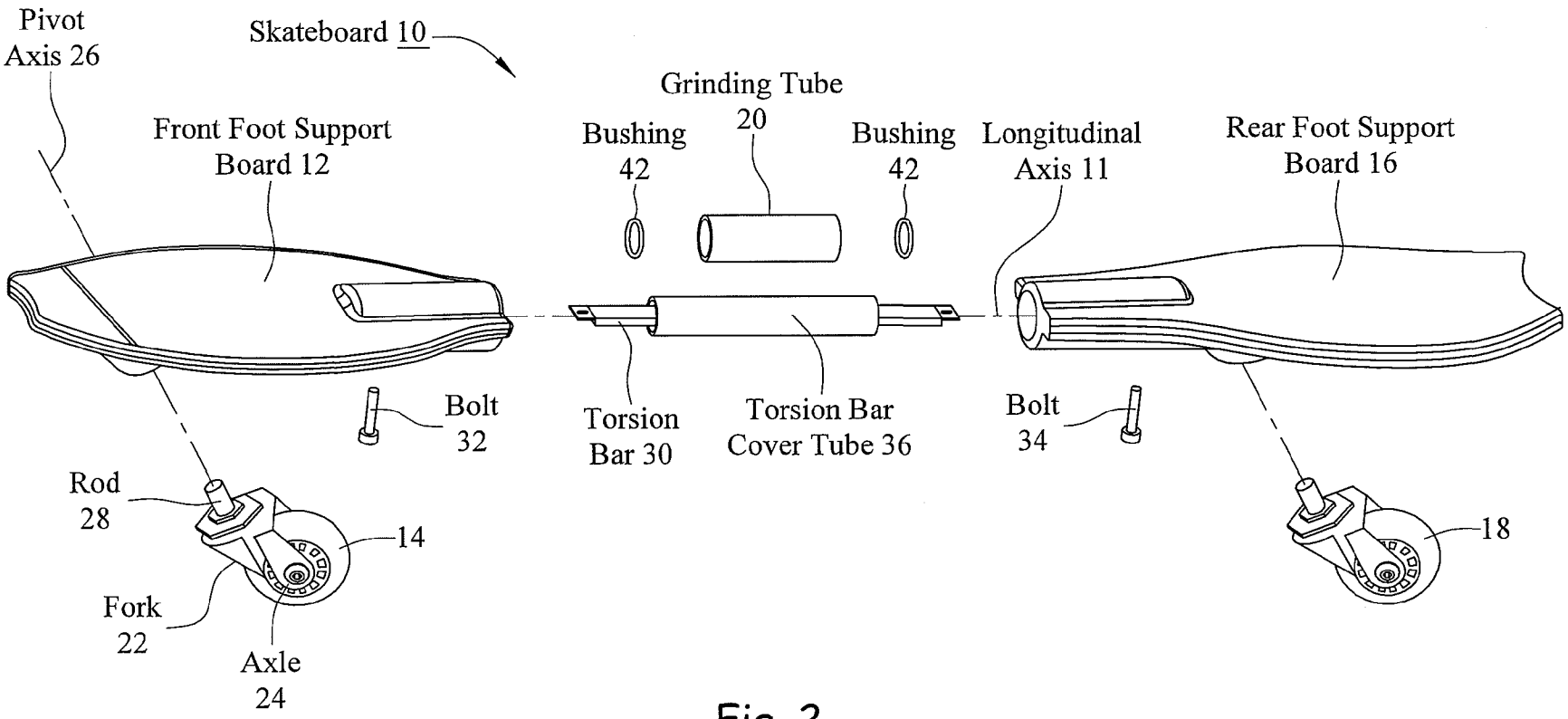
FIG. 2 is an exploded view of skateboard 10 shown in FIG. 1.

Referring now to FIG. 2, skateboard 10 is illustrated in an exploded isometric view in which front board 12 is shown moved to the left of grinding tube 20 while rear board 16 is moved to the right. Wheel 14 is moved down from front board 14 and is mounted to fork 22 via axle 24. Fork 22 is mounted for pivotal rotation about axis 26 through threaded rod 28. Wheel 18 is shown below rear board 16 and is mounted thereto in a similar manner.

Figure 3:
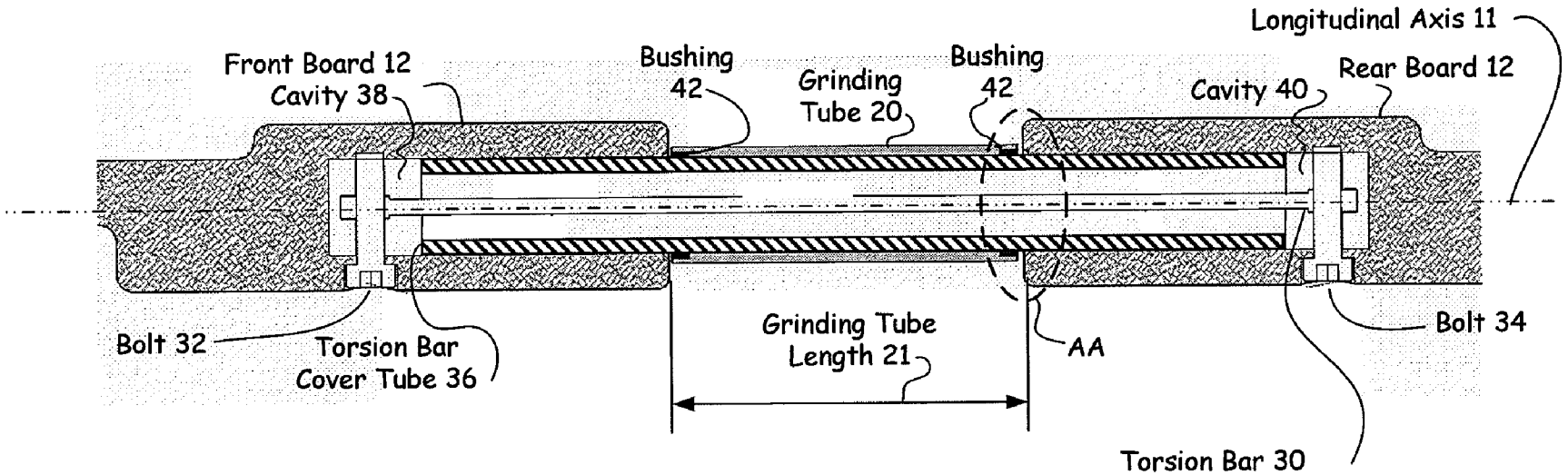
FIG. 3 is an cross sectional front view of grinding tube 20 and associated components.

Referring now also to FIG. 3, torsion bar 30 is coaxial with longitudinal axis 11 and is captured within a cavity in front board 12 by bolt 32 and within a cavity in rear board 16 by bolt 34. During operation, when a rider rotates front and rear boards 12 and 16 relative to each other, torsion bar 30 is twisted. Torsion bar cover tube 36 is mounted around torsion bar 30 and is mounted at one end to front board 12 in cavity 38 and at the other end to rear board 16 in cavity 40. Cover tube 36 may be mounted for rotation in either or both cavities, providing resistance to bending transverse to longitudinal axis 11. Cover tube 36 may also be fixed at both ends so that torsion bar cover tube 36 also resists twisting along longitudinal axis 11.

Grinding tube 20 is surrounds torsion bar cover tube 36 with limited lateral play along longitudinal axis 11 and is coaxial with longitudinal axis 11. Grinding tube 20 is mounted for rotation about axis 11 and may be fabricated from a piece of aluminum or plastic pipe or similar material internally smooth enough to rotate easily around torsion bar cover tube 36. Grinding tube 20 may also be made of a tougher material such as steel tubing manufactured to be internally smooth enough to rotate easily about torsion bar cover tube 36 by, for example, internally grinding smooth any weld seams or other features resisting rotation. Length 21 of grinding tube 20 separates the front and read foot support boards by an appropriate distance so that grinding tube 20 can conveniently be used as a handle to carry skateboard 10.

Figure 4:
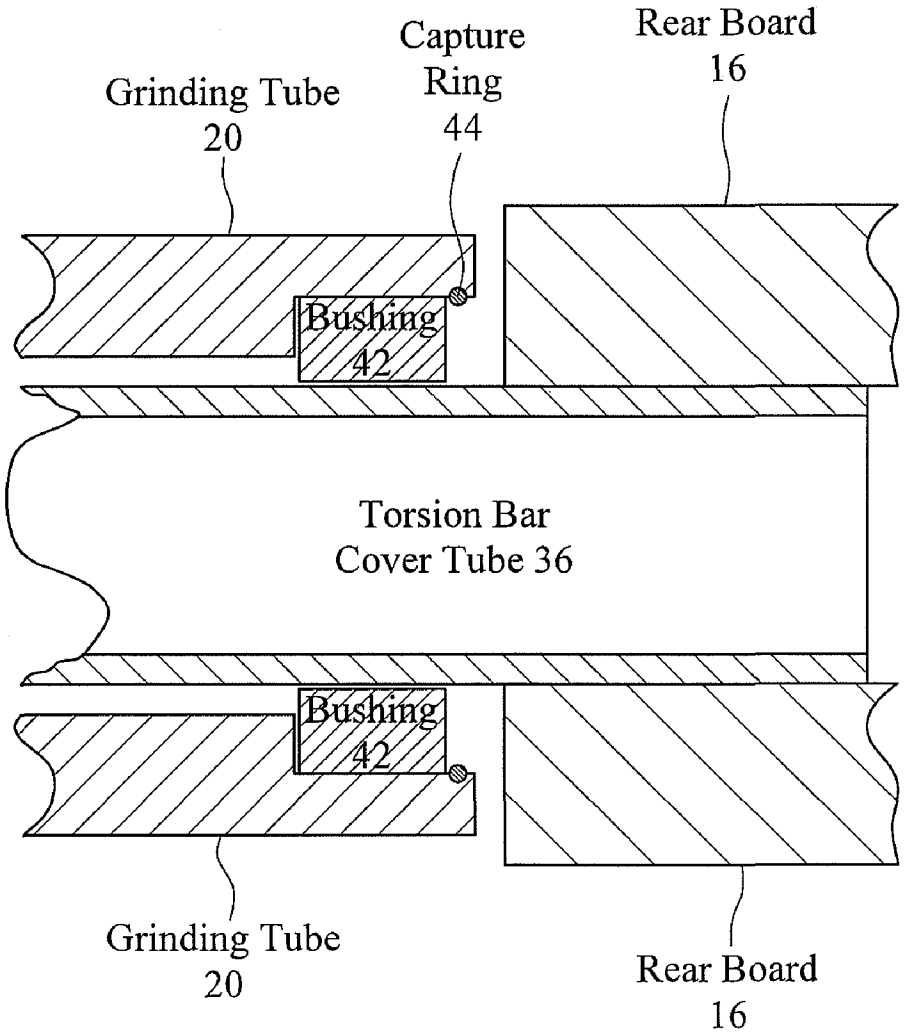
FIG. 4 is an expanded partial cross section of one end of torsion bar cover tube 36 representing the area in dashed line circle AA shown in FIG. 3.

Referring now also to FIG. 4, an expanded partial cross section of one end of torsion bar cover tube 36 is shown representing the area in dashed line circle AA shown in FIG. 3. Torsion bar 20 is not shown within cover tube 36 for clarity. Cover tube 16 is inserted in a cavity at one end of rear board 16. Bushing ring 42 is mounted coaxially on cover tube 36 in the space between front and rear boards 14, 16. Grinding tube 20 is also coaxial with cover tube 36 and may be supported in whole or in part for rotation by circular bushings 42 which may rest on torsion bar cover tube 36 and at least partially support grinding tube 20. Bushings 42 may be made of a plastic material which facilitates rotation of grinding tube 20 about torsion bar cover tube 36 during grinding maneuvers. Grinding tube 20 may touch torsion bar cover tube 36, particularly during grinding maneuvers when tube 20 is in contact with an obstacle. Additional bushings 42 may therefore be positioned along grinding tube 20, for example, in the middle of tube 20. Further, each bushing 42 may be captured by ring 44 in tube 20.

We claim:

1. A flexible skateboard comprising:

a pair of foot support boards spaced apart along a longitudal axis by a central area;

a torsion bar-connecting element fixedly mounted at each end to one of the foot support boards, the torsion bar having a twistable central portion in the central area;

a torsion bar cover tube surrounding at least the twistable central portion of the torsion bar; and a grinding tube mounted for rotation around a portion of the torsion bar cover tube in the central area, so that the grinding tube rotates to extend the length of time or distance traveled when the wheels are not fully supporting the skateboard and rider in response to contact with an obstacle.

2. The invention of claim 1, wherein each end of the torsion bar cover tube is mounted in a cavity in one of the pair of foot support boards.

3. The invention of claim 2 wherein the ends of the torsion bar cover tube each rotate with the foot support board that such end is mounted in.

4. The invention of claim 2 wherein at least one end of the torsion bar cover tube rotates within the cavity it is mounted in.

5. The invention of claim 2 wherein at least one end of the torsion bar cover tube does not rotate with respect to the foot support board it is mounted in.

6. The invention of claim 2 wherein both ends of the torsion bar cover tube do not rotate with respect to the foot support board the end is mounted in.

7. The invention of claim 1 wherein the central area is larger than the length of the grinding tube to permit rotation of the grinding tube with respect to the torsion bar cover tube.

8. The invention of claim 7 wherein the grinding tube length is appropriate for use of grinding tube as a balanced handle for carrying the skateboard so that a rider can grasp the grinding tube without having to grasp one or both of the foot support boards.

* * * * *